US012083444B2

(12) United States Patent
Milan

(10) Patent No.: US 12,083,444 B2
(45) Date of Patent: Sep. 10, 2024

(54) AMUSEMENT PARK RIDE ASSEMBLY

(71) Applicant: David Milan, Winter Haven, FL (US)

(72) Inventor: David Milan, Winter Haven, FL (US)

( * ) Notice: Subject to any disclaimer, the term of this patent is extended or adjusted under 35 U.S.C. 154(b) by 378 days.

(21) Appl. No.: 17/691,507

(22) Filed: Mar. 10, 2022

(65) Prior Publication Data

US 2023/0285866 A1 Sep. 14, 2023

(51) Int. Cl.
*A63G 21/12* (2006.01)
*A63G 7/00* (2006.01)

(52) U.S. Cl.
CPC ..... *A63G 21/12* (2013.01)

(58) Field of Classification Search
CPC ..... A63G 7/00; A63G 29/00; A63G 21/12; A63B 19/02; A63B 2208/12; A63B 21/4049
USPC ..... 472/116, 117, 40, 59, 60
See application file for complete search history.

(56) References Cited

U.S. PATENT DOCUMENTS 3,013,806 A 12/1961 Boyd
4,579,336 A * 4/1986 Morin ..... A63B 19/02 441/78
5,060,932 A 10/1991 Yamaguchi
5,193,462 A * 3/1993 Marcu ..... A63G 7/00 104/138.1
7,497,784 B2 3/2009 Henry
8,393,275 B2 3/2013 Jacobi
2007/0089633 A1* 4/2007 Kovac ..... A63G 7/00 104/53
2008/0300730 A1 12/2008 Cleary
2021/0402310 A1* 12/2021 Frison ..... A63G 21/08

FOREIGN PATENT DOCUMENTS

WO WO2019094325 5/2019

* cited by examiner

*Primary Examiner* — Kien T Nguyen

(57) ABSTRACT

An amusement park ride assembly includes a sphere which has a diameter sufficiently large for accommodating a plurality of passengers. The sphere is comprised of a translucent material to facilitate the plurality of passengers to see through the sphere. A seating unit is pivotally disposed within the sphere such that the seating unit remains in an upright orientation when the sphere is rolling. The seating unit has a plurality of chairs to facilitate each of the passengers to occupy a respective one of the chairs. A plurality of tubes is each integrated into a structural framework. Each of the tubes has a diameter is sufficient to facilitate the sphere to roll through a respective one of the tubes to facilitate the passengers in the sphere to enjoy a thrilling ride.

14 Claims, 6 Drawing Sheets

AMUSEMENT PARK RIDE ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to amusement ride device and more particularly pertains to a new amusement ride device for facilitating passengers to experience a thrilling ride. The device includes a translucent sphere of sufficient diameter to accommodate a plurality of passengers. The device includes a seating unit pivotally disposed in the sphere which remains in an upright position as the sphere rolls. The device includes a plurality of tubes which slope downwardly from a supporting framework through which the sphere is rolled for a thrilling ride.

(2) Description of Related Art Including Information Disclosed Under 37 CFR 1.97 and 1.98

The prior art relates to amusement ride devices including a spherical shell in which a single seat is disposed for facilitating a passenger to ride in the spherical shell. The prior art discloses a rotary capsule which includes a seat for a single passenger and a spherical shell which surrounds the rotary capsule. The prior art discloses an amusement ride with includes a rollable carrier which rolls down a tubular member and a water path flowing in the tubular member. The prior art discloses a roller coaster device that includes a spherical cage with travels along a roller coaster track and a seat disposed in the spherical cage. The prior art discloses an amusement ride which includes a sphere, a pair of seats disposed in the sphere and a base which has rollers for rotating the sphere.

(h) BRIEF SUMMARY OF THE INVENTION

An embodiment of the disclosure meets the needs presented above by generally comprising a sphere which has a diameter sufficiently large for accommodating a plurality of passengers. The sphere is comprised of a translucent material to facilitate the plurality of passengers to see through the sphere. A seating unit is pivotally disposed within the sphere such that the seating unit remains in an upright orientation when the sphere is rolling. The seating unit has a plurality of chairs to facilitate each of the passengers to occupy a respective one of the chairs. A plurality of tubes is each integrated into a structural framework. Each of the tubes has a diameter is sufficient to facilitate the sphere to roll through a respective one of the tubes to facilitate the passengers in the sphere to enjoy a thrilling ride.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
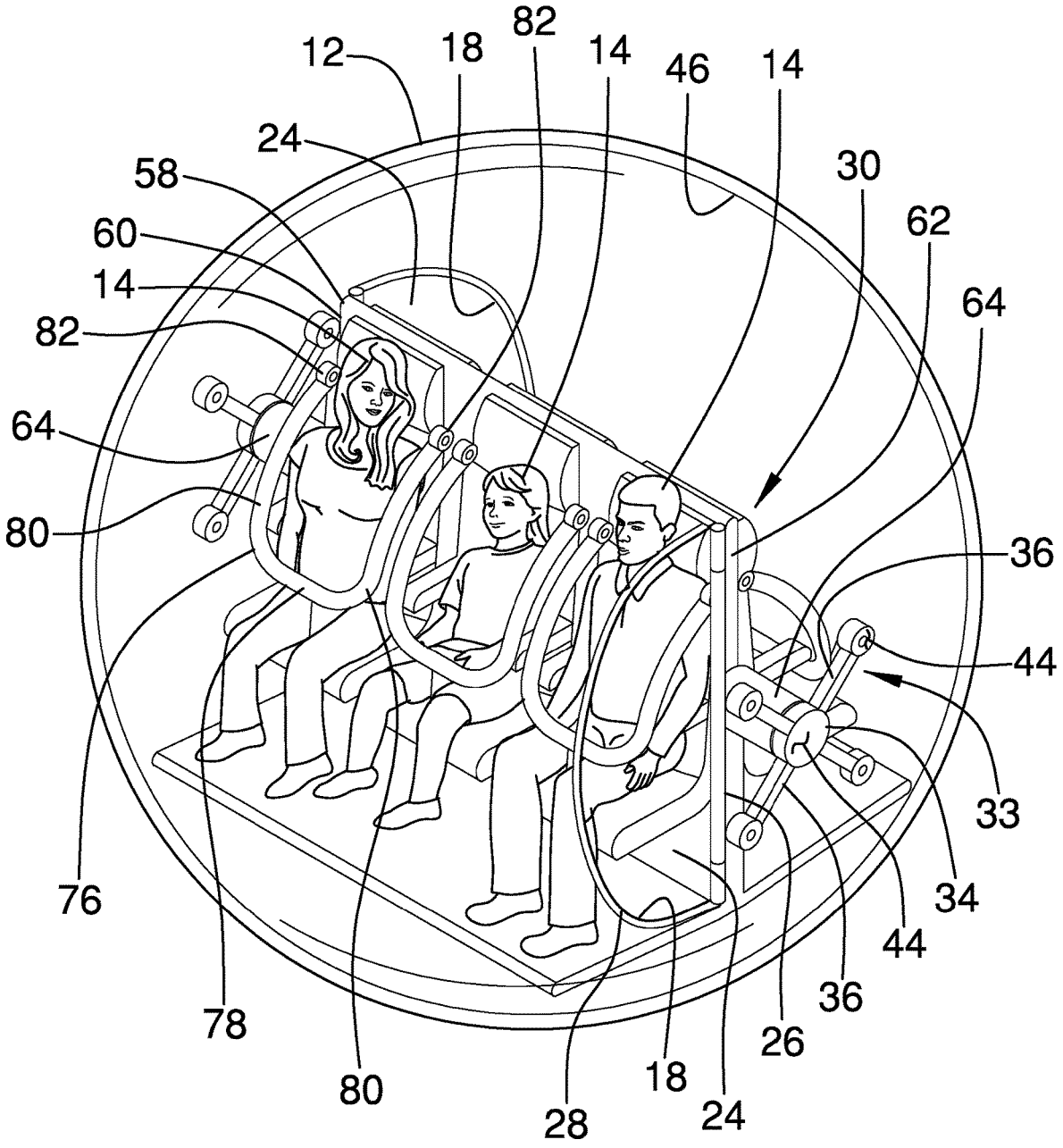
FIG. 1 is a front perspective view of sphere and a seating unit of an amusement park ride assembly according to an embodiment of the disclosure.
Figure 2:
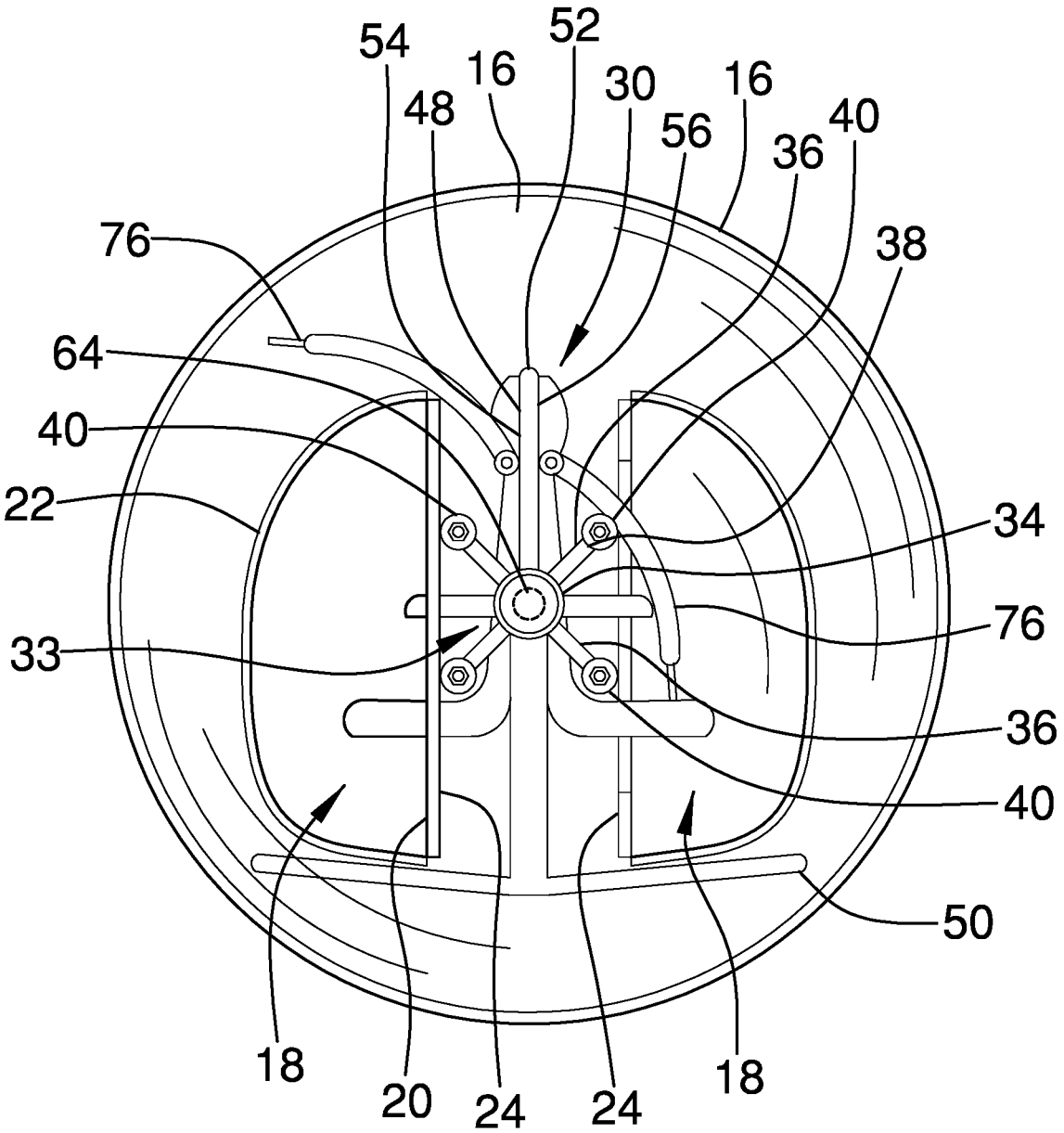
FIG. 2 is a left side view of sphere and a seating unit of an embodiment of the disclosure.
Figure 3:
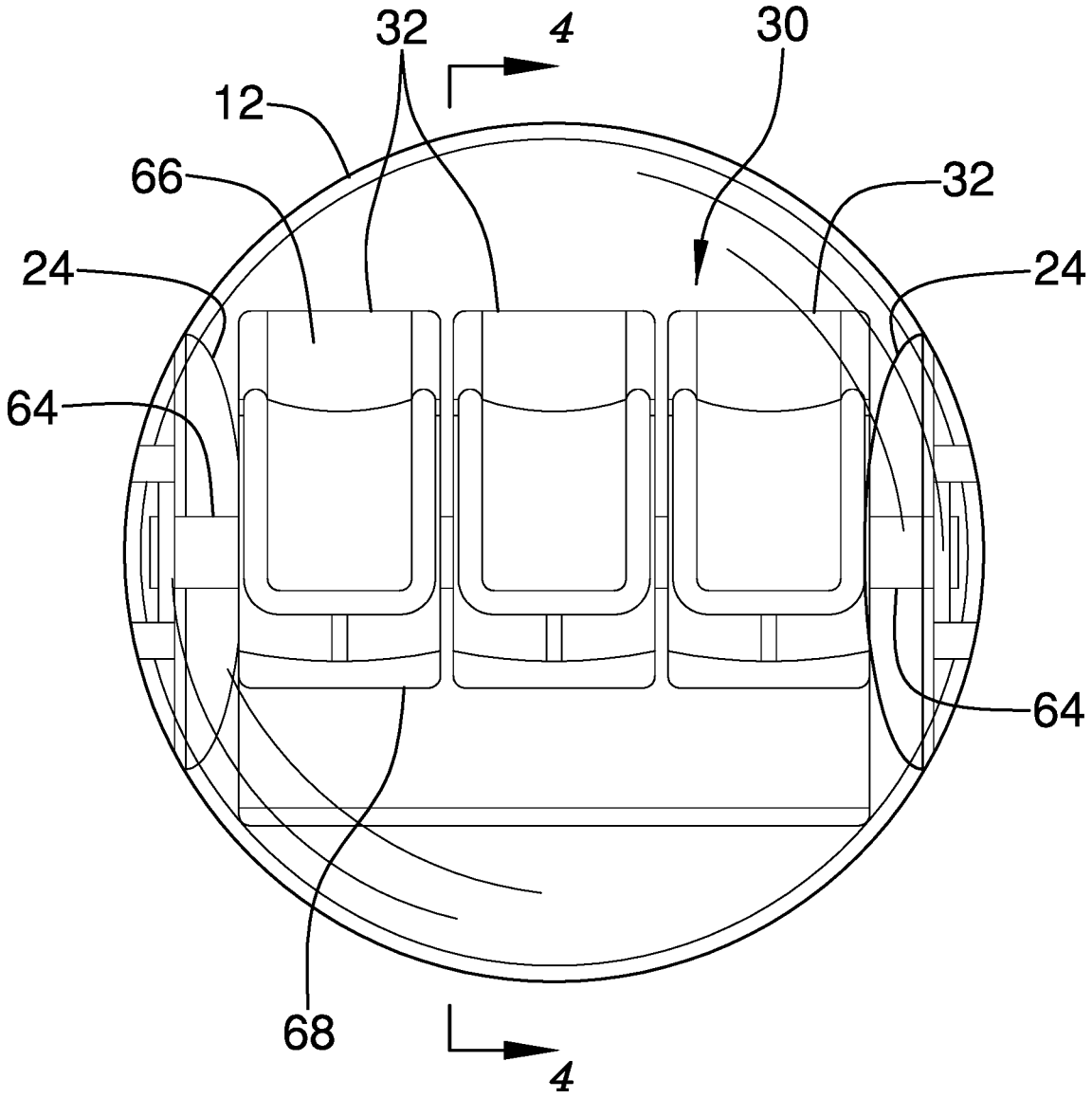
FIG. 3 is a front view of sphere and a seating unit of an embodiment of the disclosure.
Figure 4:
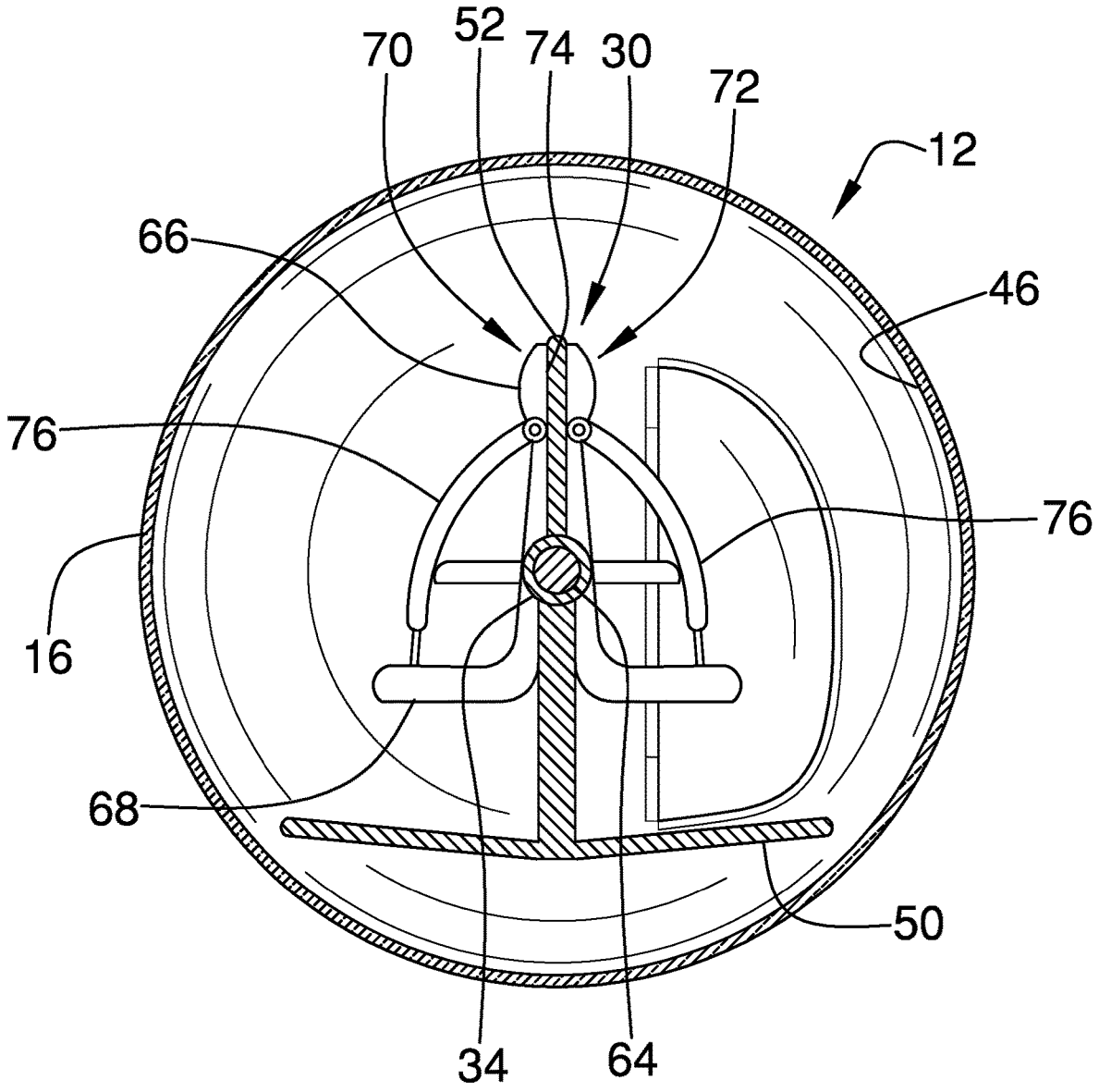
FIG. 4 is a cross sectional view taken along line 4-4 of FIG. 3 of an embodiment of the disclosure.
Figure 5:
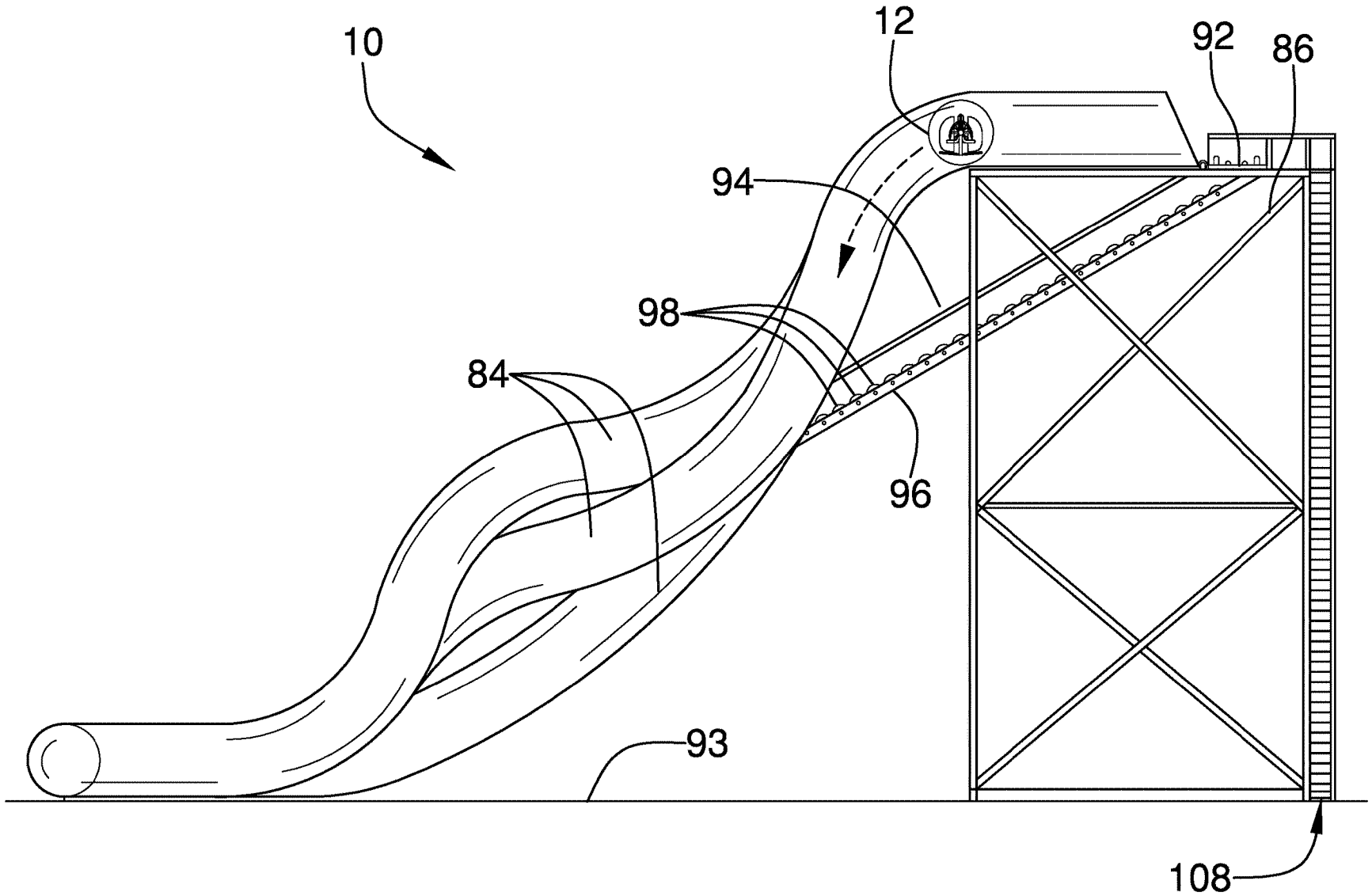
FIG. 5 is a perspective view of a plurality of tubes and a structural framework of an embodiment of the disclosure.
Figure 6:
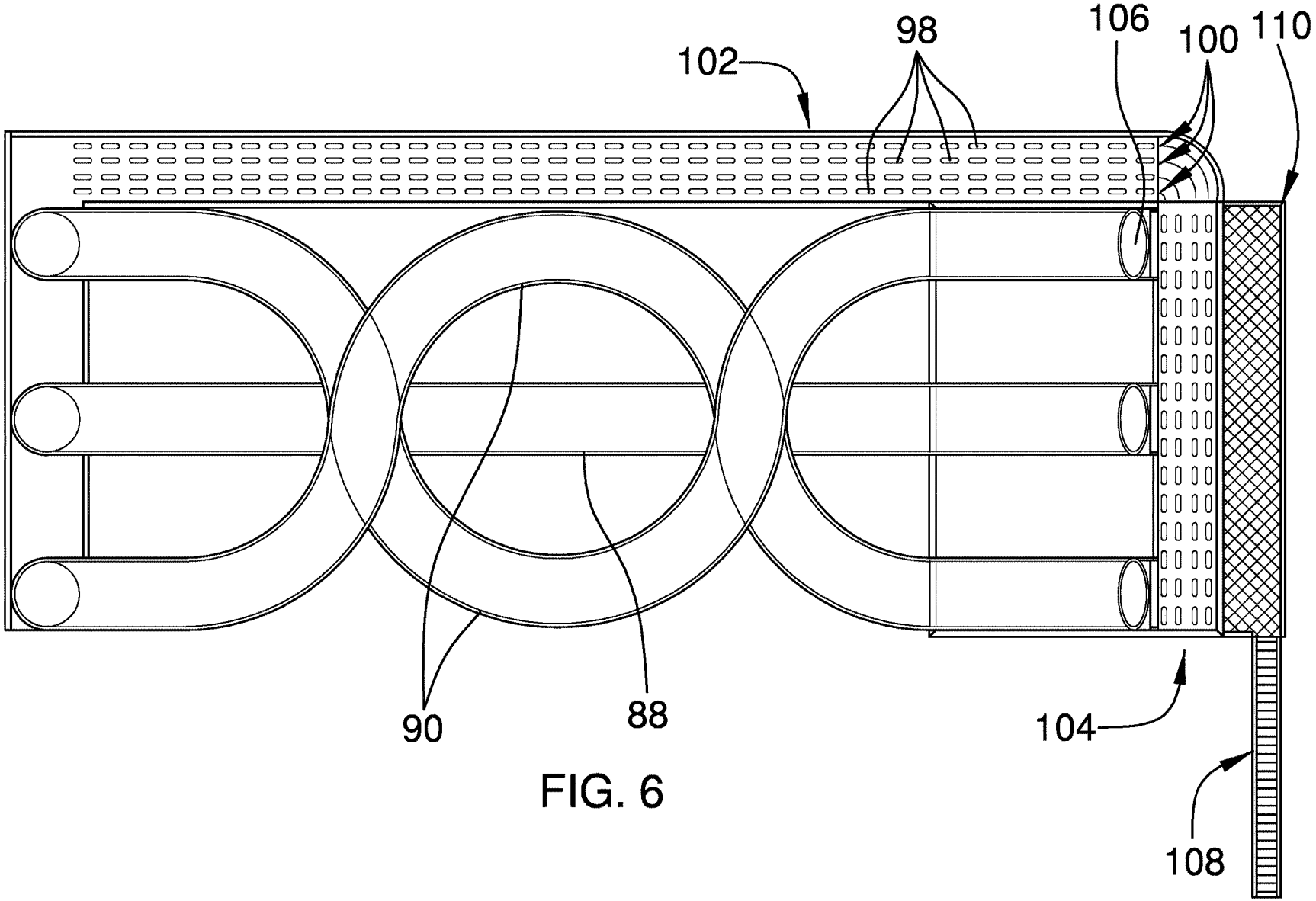
FIG. 6 is a top view of plurality of tubes and a conveyor system of an embodiment of the disclosure.

With reference now to the drawings, and in particular to FIGS. 1 through 6 thereof, a new amusement ride device embodying the principles and concepts of an embodiment of the disclosure and generally designated by the reference numeral 10 will be described.

As best illustrated in FIGS. 1 through 6, the amusement park ride assembly 10 generally comprises a sphere 12 that has a diameter which is sufficiently large for accommodating a plurality of passengers 14. The sphere 12 is comprised of a translucent material to facilitate the plurality of passengers 14 to see through the sphere 12. The sphere 12 has an outer wall 16 and the sphere 12 has a pair of entries 18 each extending through the outer wall 16 to facilitate the passengers 14 to enter or exit the sphere 12. Each of the entries 18 has a first bounding edge 20 and a second bounding edge 22. The first bounding edge 20 of each of the entries 18 extends along a straight line and the second bounding edge 22 of each of the entries 18 curves outwardly from the first bounding edge 20 such that each of the entries 18 has a semi-ovoid shape.

The entries 18 are positioned on opposing sides of the sphere 12 from each other. The first bounding edge 20 of each of the entries 18 is offset from an equator of the sphere 12. Additionally, the second bounding edge 22 of each of the entries 18 is directed in opposite directions from the equator with respect to each other. The sphere 12 has a pair of doors 24 that is each hingedly integrated into the sphere 12 and each of the doors 24 is aligned with a respective one of the entries 18. Each of the doors 24 has a first edge 26 and a second edge 28, and the first edge 26 of each of the doors 24 is hingedly coupled to the first bounding edge 20 of the respective entry 18. Furthermore, the second edge 28 of each of the doors 24 is curved to conform to curvature of the second bounding edge 22 of the respective entry 18. Additionally, each of the doors 24 has a curved profile such that each of the doors 24 conforms to the curvature of the outer wall 16 when the doors 24 are closed.

A seating unit 30 is provided and the seating unit 30 is pivotally disposed within the sphere 12. The seating unit 30 is pivotal about a central axis of the sphere 12 such that the seating unit 30 remains in an upright orientation when the sphere 12 is rolling. The seating unit 30 has a plurality of chairs 32 to facilitate each of the passengers 14 to occupy a respective one of the chairs 32. The seating unit 30 comprises a coupler 33 which has a central hub 34 and a plurality of arms 36 each radiating outwardly from the central hub 34. Each of the arms 36 has a distal end 38 with respect to the central hub 34 and the coupler 33 includes a plurality of disks 40 that is each disposed on the distal end 38 of a respective one of the arms 36.

Each of the disks 40 has a first face 42 and the central hub 34 has a primary face 44. The first face 42 of each of the disks 40 lies on a plane which is oriented coplanar with the primary face 44 of the central hub 34. The primary face 44 and the first face 42 of each of the disks 40 is attached to an inside surface 46 of the outer wall 16 of the sphere 12, and the central hub 34 is aligned with a central axis of the sphere 12. The seating unit 30 includes a pair of the couplers 33 and each of the couplers 33 is positioned adjacent to a respective one of the entries 18 in the outer wall 16 of the sphere 12.

The seating unit 30 includes a support structure 48 which has a first panel 50 and a second panel 52 extending upwardly from the first panel 50, and the second panel 52 is perpendicularly oriented with the first panel 50. The second panel 52 is centrally positioned on the first panel 50 such that the second panel 52 bisects the first panel 50. The second panel 52 has a front face 54, a rear face 56 and an outer edge 58 extending between the front face 54 and the rear face 56, and the outer edge 58 has a first lateral side 60 and a second lateral side 62. A pair of pivots 64 is provided and each of pivots 64 is coupled to and extends away from a respective one of the first lateral side 60 and the second lateral side 62 of the outer edge 58 of the second panel 52. Each of the pivots 64 rotatably engages the central hub 34 of a respective one of the couplers 33 for pivotally retaining the support structure 48 between the pair of couplers 33.

Each of the chairs 32 that each has a backrest 66 and a seat 68, and the plurality of chairs 32 include a set of first chairs 70 and a set of second chairs 72. A back surface 74 of the backrest 66 of each of the first chairs 70 is attached to the front face 54 of the second panel 52 of the support structure 48. Furthermore, the seat 68 of each of the first chairs 70 lies on a plane that is oriented parallel with the first panel 50 of the support structure 48. The back surface 74 of the backrest 66 of each of the second chairs 72 is attached to the rear face 56 of the second panel 52. The seat 68 of each of the second chairs 72 lies on a plane that is oriented parallel with the first panel 50.

A plurality of locking bars 76 is each of the locking bars 76 has a central member 78 extending between a pair of outward members 80. Each of the outward members 80 has a distal end 82 with respect to the central member 78 and the distal end 82 of each of the outward members 80 of each of the locking bars 76 is pivotally coupled to the second panel 52. Each of the locking bars 76 is aligned with a respective one of the chairs 32. Each of the locking bars 76 is positionable in a locking position having the locking bars 76 extending downwardly in front of the respective chair 32. In this way each of the locking bars 76 can restrain the passenger 14 seated in the respective chair 32. Conversely, each of the locking bars 76 is positionable in an unlocked position having each of the locking bars 76 extending upwardly from the respective chair 32. In this way the plurality of locking bars 76 facilitates the passenger 14 seated in the respective chair 32 to exit the respective chair 32.

A plurality of tubes 84 is provided and each of the tubes 84 is integrated into a structural framework 86. Each of the tubes 84 has a diameter which is sufficient to facilitate the sphere 12 to roll through a respective one of the tubes 84. In this way the tubes 84 facilitate the passengers 14 in the sphere 12 to enjoy a thrilling ride. The plurality of tubes 84 curves around each other to follow a predetermined route. In this way the plurality of tubes 84 enhance excitement for the passengers 14 in the sphere 12 when the sphere 12 travels along the respective tube. As is most clearly shown in FIG. 6, the plurality of tubes 84 may include a straight tube 88 and a pair of undulating tubes 90 which each curves back and forth across the straight tube 88. As is most clearly shown in FIG. 5, the plurality of tubes 84 may each curve upwardly and downwardly along their respective length. Each of the tubes 84 is oriented to extend downwardly from a top end 92 of the structural framework 86 toward ground 93 thereby facilitating the sphere 12 to roll downwardly through the respective tube 84.

A conveyor system 94 is provided and the conveyor system 94 is movably integrated into the structural framework 86. The conveyor system 94 is oriented to extend between the ground 93 and the top end 92 of the structural framework 86. Additionally, the conveyor system 94 includes a belt 96 that has a series of prominences 98 each extending upwardly from the belt 96. The prominences 98 are arranged into a plurality of rows 100 extending along a full length of the belt 96 such that respective ones of the prominences 98 engage the outer wall 16 of the sphere 12 when the sphere 12 is positioned on the belt 96.

The belt 96 travels between the ground 93 and the top end 92 of the structural framework 86. In this way the belt 96 transports the sphere 12 to the top end 92 of the structural framework 86 when the sphere 12 rolls out of the respective tube 84. Additionally, the conveyor system 94 has a first portion 102 extending from the ground 93 to the top end 92 of the structural framework 86. The conveyor system 94 has a second portion 104 extending along a full length of the top end 92 of the structural framework 86 for delivering the sphere 12 to an entrance 106 into a respective one of the tubes 84. The conveyor system 94 might include electric motors and drive gears that are common to conveyor belt systems for driving the belt 96.

A set of stairs 108 is provided and the set of stairs 108 extends between the ground 93 and the top end 92 of the structural framework 86. In this way individuals can walk to the top end 92 of the structural framework 86. Moreover, the top end 92 of the structural framework 86 has a walkway 110 extending along the second portion 104 of the conveyor system 94 thereby facilitating the individuals to observe the sphere 12 entering the respective tube 84.

In use, the passengers 14 enter the sphere 12 through a receptive one of the entries 18 and each of the passengers 14 is seated in a respective one of the chairs 32. The locking bars 76 are positioned in the locking position and each of the doors 24 is closed. The sphere 12 is subsequently urged into a respective one of the tubes 84 and the sphere 12 is released to roll down the respective tube 84. Furthermore, the seating unit 30 remains in an upright position while the sphere 12 rolls down the respective tube 84 at an ever increasing velocity. In this way the passengers 14 can observe their ride down the tube 84 to enhance the excitement the passengers 14 feel. The passengers 14 exit the sphere 12 when the sphere exits the respective tube 84 and the sphere 12 is positioned on the belt 96 of the conveyor system 94 to transport the sphere 12 up to the top end of the structural framework 86. In this way the next group of passengers 14 can be loaded into the sphere 12 to ride down a respective tube 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An amusement park ride assembly for facilitating riders to ride a translucent bubble through an undulating tube, said assembly comprising:

a sphere having a diameter being sufficiently large for accommodating a plurality of passengers, said sphere being comprised of a translucent material wherein said sphere is configured to facilitate the plurality of passengers to see through said sphere;

a seating unit being pivotally disposed within said sphere, said seating unit being pivotal about a central axis of said sphere such that said seating unit remains in an upright orientation when said sphere is rolling, said seating unit having a plurality of chairs wherein each of said chairs is configured to facilitate each of the passengers to occupy a respective one of said chairs;

a plurality of tubes, each of said tubes being integrated into a structural framework, each of said tubes having a diameter being sufficient to facilitate said sphere to roll through a respective one of said tubes wherein said tubes are configured to facilitate the passengers in said sphere to enjoy a thrilling ride; and a conveyor system being movably integrated into said structural framework, said conveyor system being oriented to extend between the ground and a top end of said structural framework, said conveyor system transporting said sphere to an entry of the respective one of said tubes when said sphere has traveled through said respective tubes.

2. The assembly according to claim 1, wherein:

said sphere has an outer wall, said sphere having a pair of entries each extending through said outer wall wherein each of said entries is configured to facilitate the passengers to enter or exit said sphere;

each of said entries had a first bounding edge and a second bounding edge, said first bounding edge of each of said entries extending along a straight line, said second bounding edge of each of said entries curving outwardly from said first bounding edge such that each of said entries has a semi-ovoid shape;

said pair of entries is positioned on opposing sides of said sphere from each other;

said first bounding edge of each of said entries is offset from an equator of said sphere; and said second edge of each of said entries is directed in opposite directions from said equator with respect to each other.

3. The assembly according to claim 2, wherein said sphere has a pair of doors each being hingedly integrated into said sphere, each of said doors being aligned with a respective one of said entries, each of said doors having a first edge and a second edge, said first edge of each of said doors being hingedly coupled to said first bounding edge of said respective entry, said second edge of each of said doors being curved to conform to curvature of said second bounding edge of said respective entry.

4. The assembly according to claim 2, wherein:

said seating unit comprises a coupler having a central hub and a plurality of arms each radiating outwardly from said central hub, each of said arms having a distal end with respect to said central hub;

said coupler has a plurality of disks each being disposed on said distal end of a respective one of said arms, each of said disks having a first face, said central hub having a primary face;

said first face of each of said disks lying on a plane being oriented coplanar with said primary face of said central hub;

said primary face and said first face of each of said disks is attached to an inside surface of said outer wall of said sphere; and said central hub is aligned with a central axis of said sphere.

5. The assembly according to claim 4, wherein said seating unit includes a pair of said couplers, each of said couplers being positioned adjacent to a respective one of said entries in said outer wall of said sphere.

6. The assembly according to claim 5, wherein said seating unit includes:

a support structure having a first panel and a second panel extending upwardly from said first panel and being perpendicularly oriented with said first panel, said second panel being centrally positioned on said first panel such that said second panel bisects said first panel, said second panel having a front face, a rear face and an outer edge extending between said front face and said rear face, said outer edge having a first lateral side and a second lateral side; and said a pair of pivots, each of pivots being coupled to and extending away from a respective one of said first lateral side and said second lateral side of said outer edge of said second panel, each of said pivots rotatably engaging said central hub of a respective one of said couplers for pivotally retaining said support structure between said pair of couplers.

7. The assembly according to claim 6, wherein:

said seating unit includes a plurality of said chairs having a backrest and a seat;

said plurality of chairs includes a set of first chairs and a set of second chairs;

a back surface of said backrest of each of said first chairs is attached to said front face of said second panel of said support structure having said seat of each of said first chairs lying on a plane being oriented parallel with said first panel of said support structure; and said back surface of said backrest of each of said second chairs is attached to said rear face of said second panel having said seat of each of said second chairs lying on a plane being oriented parallel with said first panel.

8. The assembly according to claim 6, further comprising:

a plurality of locking bars, each of said locking bars having a central member extending between a pair of outward members, each of said outward members having a distal end with respect to said central member, said distal end of each of said outward members of each of said locking bars being pivotally coupled to said second panel; and each of said locking bars is aligned with a respective one of said chairs.

9. The assembly according to claim 8, wherein each of said locking bars is positionable in a locking position having said locking bars extending downwardly in front of said respective chair wherein each of said locking bars is configured to restrain the passenger seated in said respective chair, each of said locking bars being positionable in an unlocked position having each of said locking bars extending upwardly from said respective chair wherein said plurality of locking bars is configured to facilitate the passenger seated in said respective chair to exit said respective chair.

10. The assembly according to claim 2, wherein said conveyor system includes a belt having a series of prominences each extending upwardly from said belt, said prominences being arranged into a plurality of rows extending along a full length of said belt such that respective ones of said prominences engages said outer wall of said sphere when said sphere is positioned on said belt, said belt traveling between the ground and said top end of said structural framework thereby facilitating said sphere to be transported to said top end of said structural framework when said sphere rolls out of said respective tube.

11. The assembly according to claim 10, wherein said conveyor system has a first portion extending from the ground to said top end of said structural framework, said conveyor system having a second portion extending along a full length of said top end of said structural framework for delivering said sphere to an entrance into a respective one of said tubes.

12. The assembly according to claim 11, further comprising a set of stairs each extending between the ground and said top end of said structural framework thereby facilitating individuals to walk to said top end of said structural framework, said top end of said structural framework having a walkway extending along said second portion of said conveyor system thereby facilitating the individuals to observe said sphere entering said respective tube.

13. The assembly according to claim 1, wherein said plurality of tubes curves around each other to follow a predetermined route wherein said plurality of tubes is configured to enhance excitement for the passengers in said sphere when said sphere travels along said respective tube, each of said tubes being oriented to extend downwardly from a top end of said structural framework toward ground thereby facilitating said sphere to roll downwardly through said respective tube.

14. An amusement park ride assembly for facilitating riders to ride a translucent bubble through an undulating tube, said assembly comprising:

a sphere having a diameter being sufficiently large for accommodating a plurality of passengers, said sphere being comprised of a translucent material wherein said sphere is configured to facilitate the plurality of passengers to see through said sphere, said sphere having an outer wall, said sphere having a pair of entries each extending through said outer wall wherein each of said entries is configured to facilitate the passengers to enter or exit said sphere, each of said entries having a first bounding edge and a second bounding edge, said first bounding edge of each of said entries extending along a straight line, said second bounding edge of each of said entries curving outwardly from said first bounding edge such that each of said entries has a semi-ovoid shape, said pair of entries being positioned on opposing sides of said sphere from each other, said first bounding edge of each of said entries being offset from an equator of said sphere, said second edge of each of said entries being directed in opposite directions from said equator with respect to each other, said sphere having a pair of doors each being hingedly integrated into said sphere, each of said doors being aligned with a respective one of said entries, each of said doors having a first edge and a second edge, said first edge of each of said doors being hingedly coupled to said first bounding edge of said respective entry, said second edge of each of said doors being curved to conform to curvature of said second bounding edge of said respective entry;

a seating unit being pivotally disposed within said sphere, said seating unit being pivotal about a central axis of said sphere such that said seating unit remains in an upright orientation when said sphere is rolling, said seating unit having a plurality of chairs wherein each of said chairs is configured to facilitate each of the passengers to occupy a respective one of said chairs, said seating unit comprising:

a coupler having a central hub and a plurality of arms each radiating outwardly from said central hub, each of said arms having a distal end with respect to said central hub, said coupler having a plurality of disks each being disposed on said distal end of a respective one of said arms, each of said disks having a first face, said central hub having a primary face, said first face of each of said disks lying on a plane being oriented coplanar with said primary face of said central hub, said primary face and said first face of each of said disks being attached to an inside surface of said outer wall of said sphere, said central hub being aligned with a central axis of said sphere;

wherein said seating unit includes a pair of said couplers, each of said couplers being positioned adjacent to a respective one of said entries in said outer wall of said sphere;

a support structure having a first panel and a second panel extending upwardly from said first panel and being perpendicularly oriented with said first panel, said second panel being centrally positioned on said first panel such that said second panel bisects said first panel, said second panel having a front face, a rear face and an outer edge extending between said front face and said rear face, said outer edge having a first lateral side and a second lateral side;

a pair of pivots, each of pivots being coupled to and extending away from a respective one of said first lateral side and said second lateral side of said outer edge of said second panel, each of said pivots rotatably engaging said central hub of a respective one of said couplers for pivotally retaining said support structure between said pair of couplers;

a plurality of said chairs having a backrest and a seat, said plurality of chairs including a set of first chairs and a set of second chairs, a back surface of said backrest of each of said first chairs being attached to said front face of said second panel of said support structure having said seat of each of said first chairs lying on a plane being oriented parallel with said first panel of said support structure, said back surface of said backrest of each of said second chairs being attached to said rear face of said second panel having said seat of each of said second chairs lying on a plane being oriented parallel with said first panel; and a plurality of locking bars, each of said locking bars having a central member extending between a pair of outward members, each of said outward members having a distal end with respect to said central member, said distal end of each of said outward members of each of said locking bars being pivotally coupled to said second panel, each of said locking bars being aligned with a respective one of said chairs, each of said locking bars being positionable in a locking position having said locking bars extending downwardly in front of said respective chair wherein each of said locking bars is configured to restrain the passenger seated in said respective chair, each of said locking bars being positionable in an unlocked position having each of said locking bars extending upwardly from said respective chair wherein said plurality of locking bars is configured to facilitate the passenger seated in said respective chair to exit said respective chair;

a plurality of tubes, each of said tubes being integrated into a structural framework, each of said tubes having a diameter being sufficient to facilitate said sphere to roll through a respective one of said tubes wherein said tubes are configured to facilitate the passengers in said sphere to enjoy a thrilling ride, said plurality of tubes curving around each other to follow a predetermined route wherein said plurality of tubes is configured to enhance excitement for the passengers in said sphere when said sphere travels along said respective tube, each of said tubes being oriented to extend downwardly from a top end of said structural framework toward ground thereby facilitating said sphere to roll downwardly through said respective tube;

a conveyor system being movably integrated into a structural framework, said conveyor system being oriented to extend between the ground and said top end of said structural framework, said conveyor system including a belt having a series of prominences each extending upwardly from said belt, said prominences being arranged into a plurality of rows extending along a full length of said belt such that respective ones of said prominences engages said outer wall of said sphere when said sphere is positioned on said belt, said belt traveling between the ground and said top end of said structural framework thereby facilitating said sphere to be transported to said top end of said structural framework when said sphere rolls out of said respective tube, said conveyor system having a first portion extending from the ground to said top end of said structural framework, said conveyor system having a second portion extending along a full length of said top end of said structural framework for delivering said sphere to an entrance into a respective one of said tubes; and a set of stairs each extending between the ground and said top end of said structural framework thereby facilitating individuals to walk to said top end of said structural framework, said top end of said structural framework having a walkway extending along said second portion of said conveyor system thereby facilitating the individuals to observe said sphere entering said respective tube.

* * * * *